US010845045B1

(12) United States Patent
Armenante

(10) Patent No.: US 10,845,045 B1
(45) Date of Patent: Nov. 24, 2020

(54) WALL FLOWER LAMP

(71) Applicant: Andre Armenante, Highland Park, IL (US)

(72) Inventor: Andre Armenante, Highland Park, IL (US)

( * ) Notice: Subject to any disclaimer, the term of this patent is extended or adjusted under 35 U.S.C. 154(b) by 0 days.

(21) Appl. No.: 16/678,705

(22) Filed: Nov. 8, 2019

Related U.S. Application Data

(60) Provisional application No. 62/757,725, filed on Nov. 8, 2018.

(51) Int. Cl.

| | |
|---|---|
| ***F21V 23/04*** | (2006.01) |
| ***F21S 8/00*** | (2006.01) |
| ***A41G 1/00*** | (2006.01) |
| ***F21Y 115/10*** | (2016.01) |
| ***F21W 121/00*** | (2006.01) |

(52) U.S. Cl.
CPC ..... *F21V 23/0435* (2013.01); *A41G 1/005* (2013.01); *F21S 8/033* (2013.01); *F21W 2121/00* (2013.01); *F21Y 2115/10* (2016.08)

(58) Field of Classification Search
CPC ..... A41G 1/005; F21S 8/033; F21V 33/004; F21V 23/0435
See application file for complete search history.

(56) References Cited

U.S. PATENT DOCUMENTS

| | | | | |
|---|---|---|---|---|
| 7,458,698 | B2 * | 12/2008 | Heathcock | F21S 9/02 362/101 |
| 2009/0219711 | A1 * | 9/2009 | Webb | A41G 1/005 362/122 |
| 2013/0015782 | A1 * | 1/2013 | Weiser | F21S 6/002 315/297 |
| 2017/0013337 | A1 * | 1/2017 | Costello | H04R 1/028 |
| 2018/0045389 | A1 * | 2/2018 | Tu | F21V 23/003 |

* cited by examiner

*Primary Examiner* — Bryon T Gyllstrom
*Assistant Examiner* — Eric T Eide
(74) *Attorney, Agent, or Firm* — Robert W. J. Usher

(57) ABSTRACT

A wall flower lamp having an LED powered receptacle portion with a back face for mounting on a wall; a ring of sectorial, artificial sepals covering the front face; an LED mounted centrally on the front face and, a series of narrow elongate, artificial petals extending from the eye radially outwards over respective individual artificial sepals, each petal mounting a LED string extending over center lines of respective sepals for illuminating surfaces of respective sepals in respective different colors simultaneously. The sepals have out-turned, radially extending edges that combine forming respective radially extending out-turned cusps providing a light barrier enabling the individual sepals to capture and reflect colored light from a respective overlying LED string while preventing the light leaking/bleeding onto an adjacent sepal of different color. A receiver/controller and power supply is responsive to signals from a hand held remote controller whereby the receptacle, individual sepals and the eye can be illuminated in desired or predetermined sequences of respectively different colors and/or shades.

5 Claims, 4 Drawing Sheets

Sectional view A-A

WALL FLOWER LAMP

RELATED APPLICATION

Priority is claimed from provisional application 62/757,725 filed Nov. 8, 2019, the disclosure thereof is incorporated herein by reference.

FIELD OF THE INVENTION

The invention relates to a wall flower lamp and a hand held controller therefor.

SUMMARY OF THE INVENTION

The invention provides a lighting system comprising a lamp in a shape of a stylized wall flower and a hand held remote lamp controller having a push button console mapping the layout of the front face of the wall flower lamp.

The lamp comprises:

a disk-shape, receptacle portion for mounting a back face thereof on a wall;

a ring board with a plurality of dished/concave sectors which are artificial sepals 2A-2D is mounted on a front face of the receptacle in covering relation;

a central eye mounting an illuminating LED and, a series of narrow elongate, artificial petals extending from the eye radially outwards above respective individual sepals and each mounting a LED string extending over a center line of respective sepals for illuminating surfaces of respective sepals in respectively different colors simultaneously;

the sepals having out-turned, radially extending edges so that such edges of adjacent sepals combine to forming a radially extending out-turned cusp providing a light barrier enabling the individual sepals to capture and reflect colored light from a respective overlying LED string while preventing the light leaking/bleeding onto an adjacent sepal of different color; and a receiver/controller and power supply responsive to signals from a hand held remote controller whereby the receptacle, individual sepals and the eye can be illuminated in desired or predetermined sequences of respectively different colors and/or shades.

The hand-held remote controller has a console of similar shape to the lamp with actuating buttons located in positions corresponding to the petals sepals eye and under the base for ease of operation.

The wall flower lamp comprises an LED powered, disk-shape, receptacle portion 1 for mounting a back face thereof adjacent a wall. The receptacle LED is formed as a circle of LEDS 7 extending around the receptacle periphery.

A composite ring board with a plurality of dished/concave sectors which are artificial sepals 2A-2D is mounted on a front face of the receptacle 1 in covering relation. In practice, the four sepals are molded as a single plate-form piece. A central eye 3 mounts an illuminating LED 8 and, a series of narrow elongate, artificial petals 4A-4D radiate from around the eye 3, bowing over respective individual sepals 2A-2D. Sepals 4A-4D each mount a respective LED string 9A-9D extending over a center line of respective underlying sepals for illuminating surfaces of respective sepals in respectively different colors simultaneously.

Figure 1:
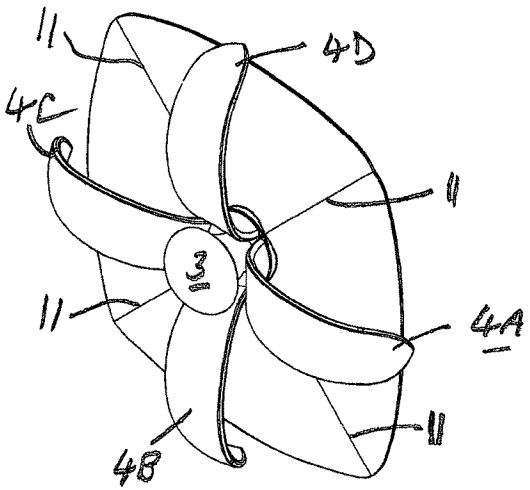
FIGS. 1-5 are respectively, a front perspective view of the wall flower lamp; a back view; a side view; a front view and a cross-sectional view along axis A-A in FIG. 4.
Figure 2:
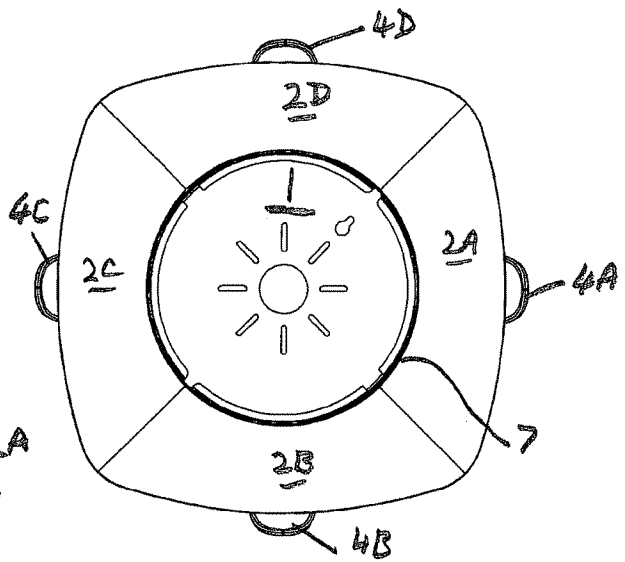
Figure 3:
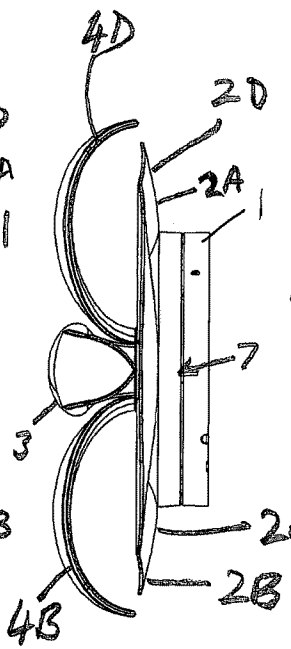
Figure 4:
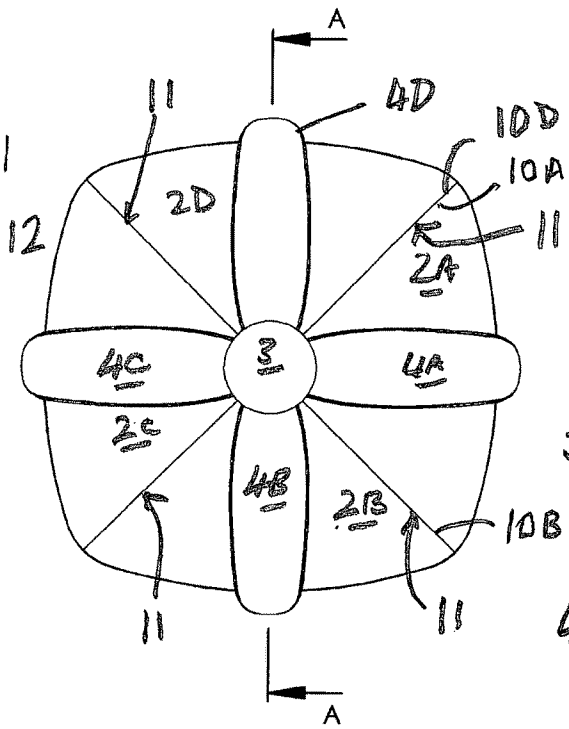
Figure 5:
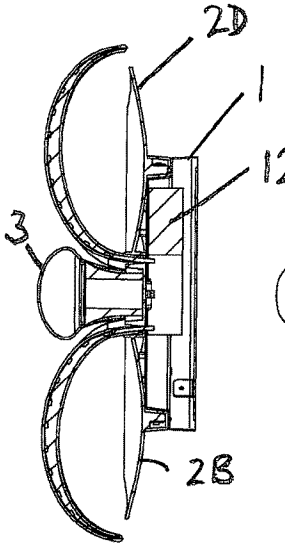
Figure 6:
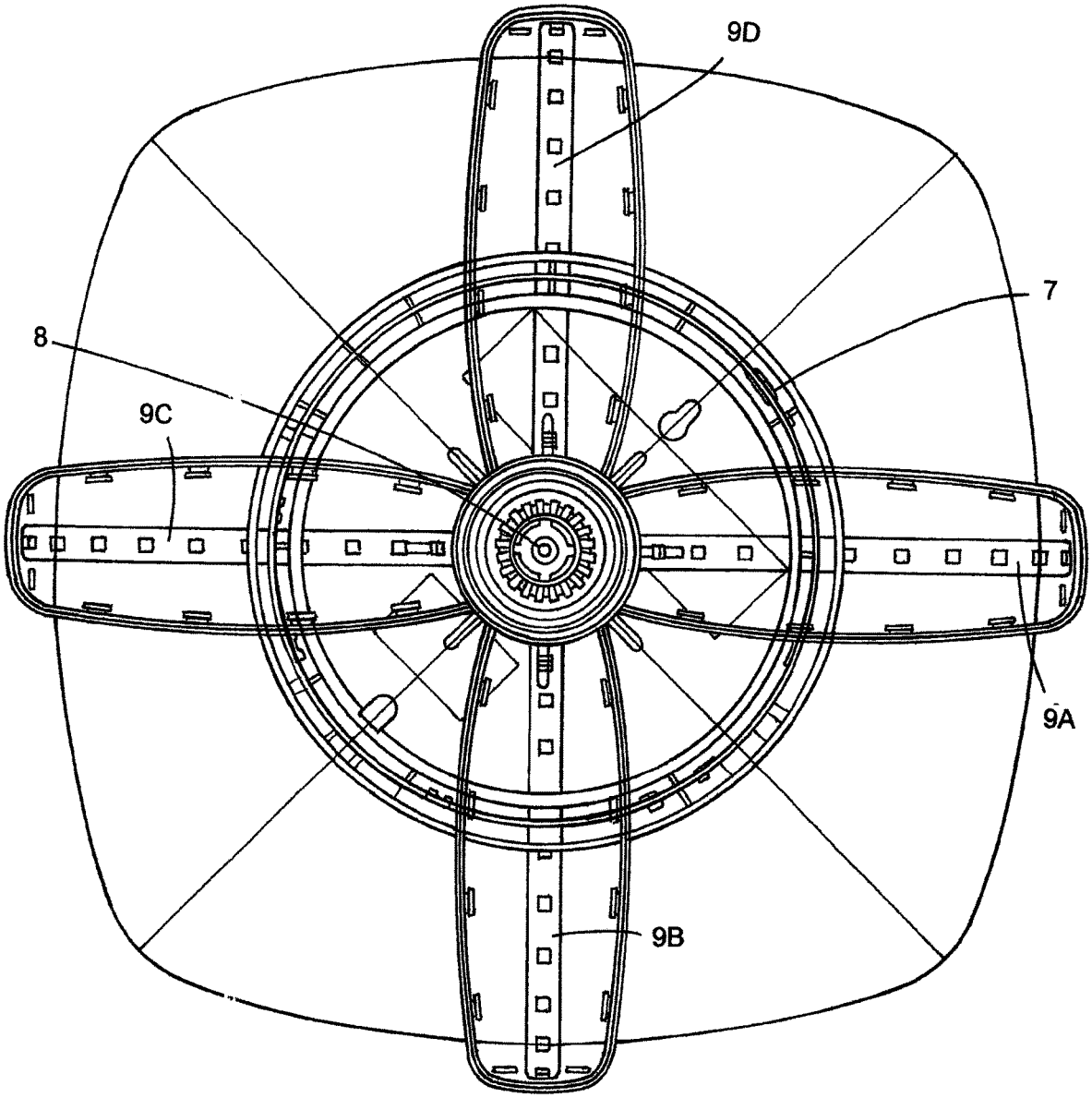
FIG. 6 is a schematic view of the lamp showing the locations of the LEDs.
Figure 7:
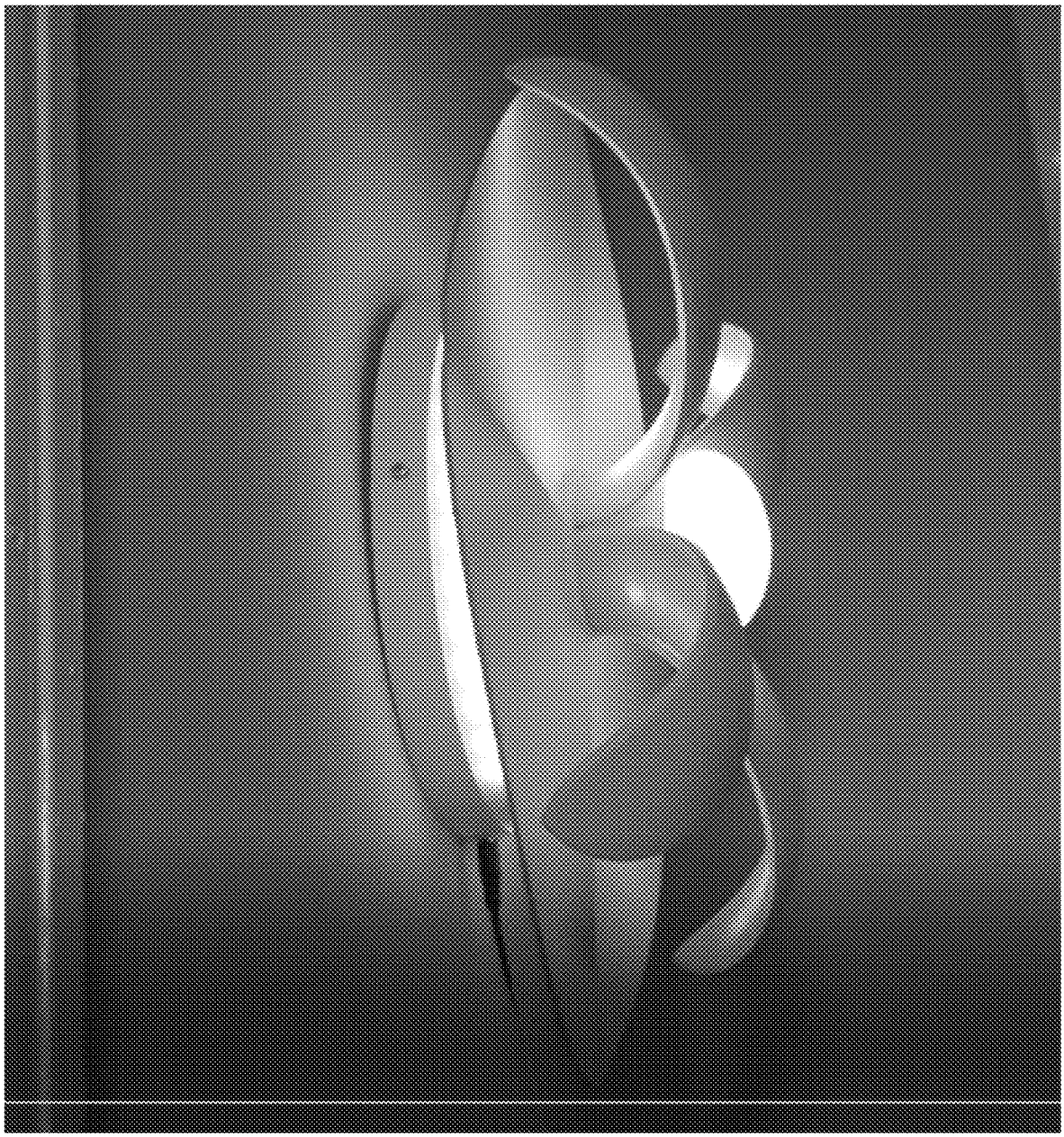
FIG. 7 is a color photographs of a wall mounted flower lamp with the base receptacle, sepals and eye each illuminated in a different color.
Figure 8:
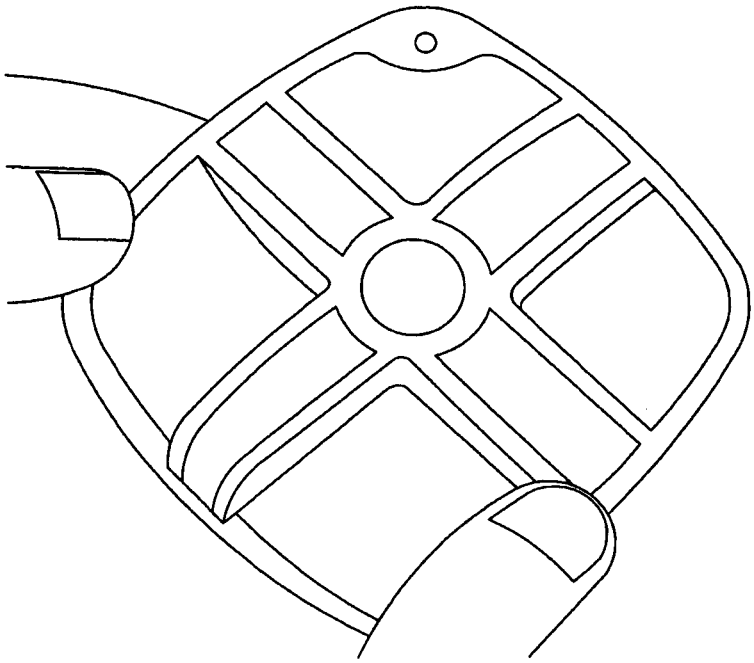
FIG. 8 is a perspective of the hand held controller.

The sepals each have opposite out-turned, radially extending edges 10A-10D so that such edges of adjacent sepals combine to forming a radially extending out-turned cusp 11 providing a light barrier enabling an individual sepal to capture and reflect colored light from a single respective overlying LED string while preventing the light color leaking/bleeding onto an adjacent sl of different color, as shown in FIG. 7.

A receiver/controller IC 12 and power supply is responsive to signals from a hand held remote controller whereby the receptacle, individual sepals and the eye can be illuminated in desired or predetermined sequences of respectively different colors and/or shades.

The hand-held remote controller has a console of similar shape to the lamp with actuating buttons located in positions corresponding to the petals, sepals, eye and under the base, for ease of operation.

The invention claimed is:

1. A wall flower lamp comprising:

a disk-shape, receptacle portion having a front face and, a back face for mounting on a wall;

a ring board with a plurality of dished/concave sectors which are artificial sepals mounted on the front face of the receptacle in covering relation;

a central eye on the front face, mounting an illuminating LED and, a series of narrow elongate, artificial petals extending from the eye radially outwards over respective individual artificial sepals, each artificial petal mounting a LED string extending over center lines of respective artificial sepals for illuminating surfaces of respective artificial sepals in respective different colors simultaneously;

the artificial sepals having out-turned, radially extending edges so that adjacent pairs of edges of adjacent artificial sepals combine to forming a radially extending out-turned cusp providing a light barrier enabling the individual artificial sepals to capture and reflect colored light from a respective overlying LED string while preventing the light leaking/bleeding onto an adjacent artificial sepal of different color; and a receiver/controller and power supply responsive to signals from a hand held remote controller whereby the receptacle, individual sepals and the eye can be illuminated in desired or predetermined sequences of respectively different colors and/or shades.

2. A wall flower lamp according to claim 1 wherein the artificial sepals are integrally joined together along their respective adjacent radially extending edges.

3. A wall flower lamp according to claim 1 wherein the hand-held remote controller has a console of similar shape to the front face of the lamp with actuating buttons located in positions corresponding to the artificial petals, artificial sepals, eye and under the base for ease of user operation.

4. A wall flower lamp face comprising:

a ring board with a plurality of dished/concave sectors which are artificial sepals;

a series of narrow elongate, artificial petals mounted concentrically with the ring of artificial sepals so that respective artificial petals extend radially outwards over respective individual artificial sepals, each artificial petal mounting a LED string extending over center lines of respective artificial sepal for illuminating surfaces of respective artificial sepals in respective different colors simultaneously; wherein the artificial sepals each have out-turned, radially extending edges so that adjacent pairs of edges of adjacent artificial sepals combine to forming a radially extending out-turned cusp providing a light barrier enabling the individual artificial sepals to capture and reflect colored light from a respective overlying LED string while preventing the light leaking/bleeding onto an adjacent artificial sepal of different color.

5. A wall flower lamp face according to claim 4 wherein the artificial sepals are integrally joined together along their respective adjacent radially extending edges to form a single, plate-form piece.

* * * * *